US010570684B2

(12) United States Patent
Brown-Kerr et al.

(10) Patent No.: US 10,570,684 B2
(45) Date of Patent: Feb. 25, 2020

(54) ORIENTATION AND ACTUATION OF PRESSURE-ACTIVATED TOOLS

(71) Applicant: Halliburton Energy Services, Inc., Houston, TX (US)

(72) Inventors: William Brown-Kerr, Aboyne (GB); Bruce Hermann Forsyth McGarian, Stonehaven (GB)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 15/761,007

(22) PCT Filed: Dec. 15, 2015

(86) PCT No.: PCT/US2015/065701
§ 371 (c)(1),
(2) Date: Mar. 16, 2018

(87) PCT Pub. No.: WO2017/105401
PCT Pub. Date: Jun. 22, 2017

(65) Prior Publication Data

US 2019/0106954 A1 Apr. 11, 2019

(51) Int. Cl.
*E21B 21/10* (2006.01)
*E21B 34/10* (2006.01)
(Continued)

(52) U.S. Cl.
CPC ..... *E21B 21/10* (2013.01); *E21B 34/103* (2013.01); *E21B 47/18* (2013.01); *E21B 2034/007* (2013.01)

(58) Field of Classification Search
CPC ..... E21B 21/10; E21B 34/103; E21B 47/18
See application file for complete search history.

(56) References Cited

U.S. PATENT DOCUMENTS 5,443,129 A * 8/1995 Bailey ..... E21B 7/061 175/45
5,456,316 A 10/1995 Owens et al.
(Continued)

FOREIGN PATENT DOCUMENTS

DE 19849933 A1 5/2000
WO WO-2014013256 A1 1/2014

OTHER PUBLICATIONS

International Search Report and Written Opinion from PCT/US2015/065701, dated Sep. 2, 2016, 11 pages.

*Primary Examiner* — Matthew R Buck
(74) *Attorney, Agent, or Firm* — Scott Richardson; C. Tumey Law Group PLLC

(57) ABSTRACT

A downhole assembly includes a tool-orienting device including an operating unit that obtains downhole measurements and a pulse-generating device that transmits the downhole measurements to orient a downhole tool. A restrictor sub is coupled to the tool-orienting device and includes a nozzle that restricts fluid flow therethrough, and a circulating valve is coupled to the restrictor sub and includes a nozzle that restricts fluid flow therethrough. A liner running tool is coupled to the circulating valve to convey a liner and a pressure-activated tool into the wellbore. The pulse-generating device operates with a fluid at a first pressure and the restrictor sub is actuatable by increasing the first pressure to a second pressure. The circulating valve is actuated by the fluid at a third pressure and the pressure-activated tool is activated by increasing third pressure to a fourth pressure.

20 Claims, 9 Drawing Sheets

(51) Int. Cl.
*E21B 47/18* (2012.01)
*E21B 34/00* (2006.01)

(56) References Cited

U.S. PATENT DOCUMENTS

| | | | | |
|---|---|---|---|---|
| 5,730,219 | A | 3/1998 | Tubel et al. | |
| 5,868,201 | A | 2/1999 | Bussear et al. | |
| 6,046,685 | A | 4/2000 | Tubel | |
| 6,206,108 | B1 | 3/2001 | MacDonald et al. | |
| 6,766,254 | B1 | 7/2004 | Bradford et al. | |
| 6,968,909 | B2 | 11/2005 | Aldred et al. | |
| 7,171,309 | B2 | 1/2007 | Goodman | |
| 7,628,213 | B2 * | 12/2009 | Telfer | E21B 21/103 166/222 |
| 8,555,983 | B2 * | 10/2013 | Palacios | E21B 23/04 166/316 |
| 2003/0016164 | A1 | 1/2003 | Finke et al. | |
| 2009/0183921 | A1 | 7/2009 | Gurjar et al. | |
| 2010/0108383 | A1 | 5/2010 | Hay et al. | |
| 2013/0008648 | A1 | 1/2013 | Lovorn et al. | |
| 2013/0213644 | A1 | 8/2013 | Buyers et al. | |
| 2013/0292110 | A1 * | 11/2013 | Fraser | E21B 47/18 166/250.01 |
| 2014/0076632 | A1 | 3/2014 | Wessling et al. | |
| 2015/0184506 | A1 * | 7/2015 | Brown-Kerr | E21B 47/18 166/373 |

* cited by examiner

ORIENTATION AND ACTUATION OF PRESSURE-ACTIVATED TOOLS

BACKGROUND

In the oil and gas industry, a wellbore is typically drilled from the Earth's surface using a string of drill pipe with a drill bit at its distal end. Drilling fluid (commonly referred to as "mud") is circulated down through the drill pipe to cool the drill bit and return drill cuttings to the surface along the annulus formed between the drill pipe and the wall of the wellbore. The drilled wellbore is then often completed by lining the wellbore with bore-lining tubing commonly referred to as casing, which can be cemented to the inner wall of the wellbore to seal the wellbore from the surrounding subterranean formations and help prevent wellbore collapse. In some wellbores, two or more concentric strings of casing are suspended from a wellhead installation and both extend into the wellbore to varying depths.

Other bore-lining tubing commonly referred to as a liner may be installed in lower portions of the wellbore. Unlike the above-described casing, the liner does not extend to the wellhead installation but is instead coupled to the distal end of the lower-most section of casing. A wide range of downhole tools and equipment are used to run and locate the liner within the wellbore. Such downhole tools include centralizers for centralizing the liner within the wellbore, drift tools used to verify an internal diameter of the wellbore, production tubing used to convey wellbore fluids to the surface, and a work string used to convey the liner downhole. Other downhole tools might include packers, valves, circulation tools, and casing perforation tools.

Some of the downhole tools used to situate and set a liner in the wellbore are actuated and otherwise operated based on a pre-defined pressure differential or pressure threshold. If the pre-defined pressure threshold is prematurely surpassed, the downhole tool may inadvertently actuate and thereby frustrate the operation of properly setting the liner within the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present application is related to downhole operations in the oil and gas industry and, more particularly, to the orientation of downhole tools and subsequent actuation of a pressure-activated tool.

Embodiments described herein allow a well operator to prevent the setting of pre-defined pressure-activated downhole tools while providing real-time pulsed telemetry. A disclosed example method of operation includes advancing a downhole assembly into a wellbore on a work string. The downhole assembly includes a tool-orienting device, a restrictor sub operatively and fluidly coupled to the tool-orienting device, a circulating valve operatively and fluidly coupled to the restrictor sub, and a liner running tool operatively coupled to the circulating valve to convey a liner and a pressure-activated tool into the wellbore. A fluid is then pumped through the work string and the downhole assembly at a first flow rate, corresponding to a first pressure of the fluid. Downhole parameter measurements are then obtained with an operating unit of the tool-orienting device. The downhole parameter measurements are then transmitted to a surface location with a pulse-generating device of the tool-orienting device to orient a downhole tool within the wellbore. In some cases, the downhole tool may be the liner running tool.

The flow rate of the fluid through the downhole assembly is then increased by an amount that increases the pressure of the fluid to a second pressure required to actuate the restrictor sub. Actuating the restrictor sub may increase a total flow area through the restrictor sub. The fluid may then be pumped at a rate that results in a third pressure through the circulating valve to actuate the circulating valve. Increasing the third pressure to a fourth pressure activates the pressure-activated tool. In some cases, the pressure-activated tool may be a liner packer associated with the liner running tool. With the disclosed downhole assembly, the pressure required to set the liner running tool cannot be generated until the circulating valve has actuated. Moreover, the pressure drop (as a function of flow rate) required to actuate the circulating valve cannot be generated until the restrictor sub has actuated.

Figure 1:
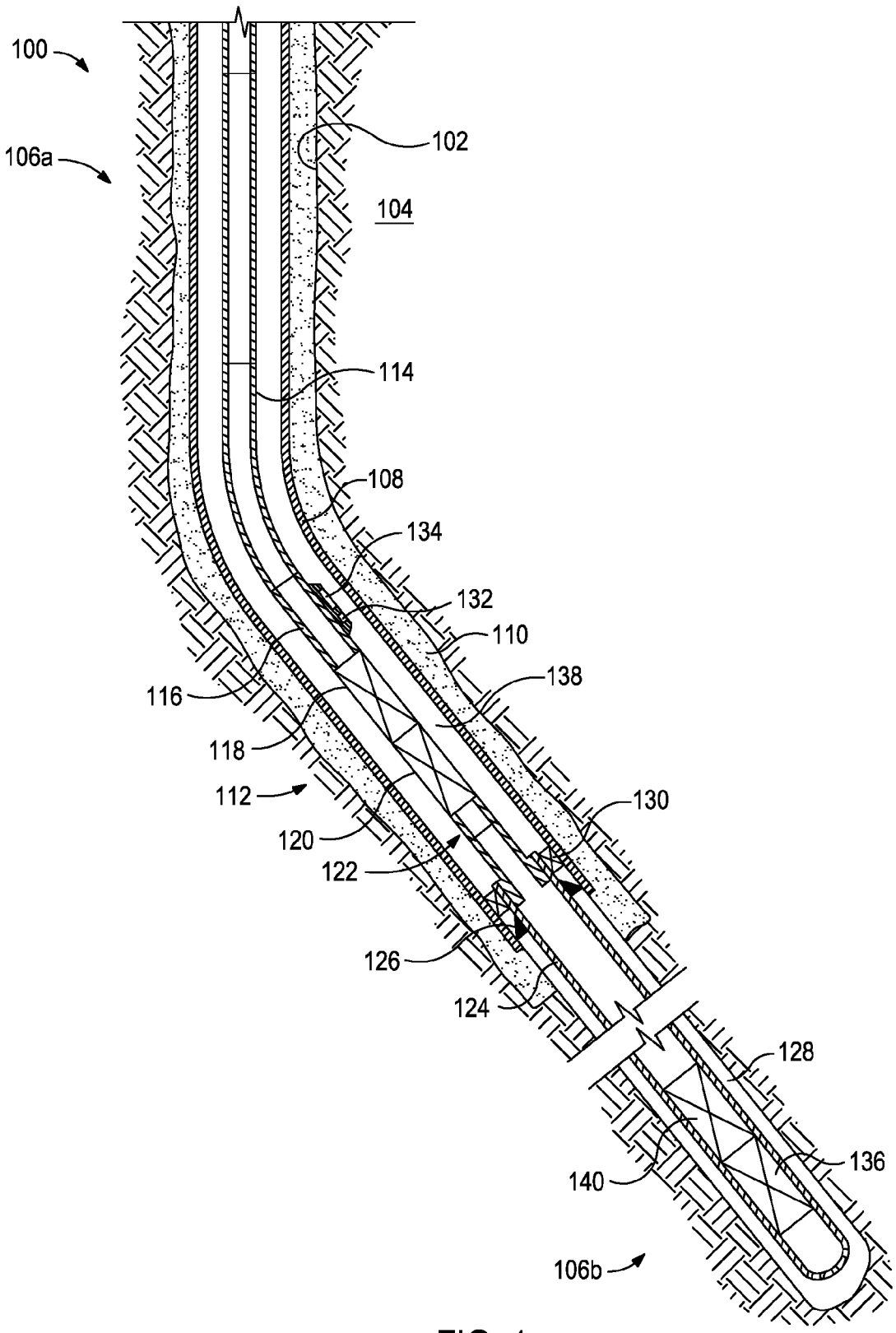
FIG. 1 is a schematic of an exemplary well system that may incorporate the principles of the present disclosure.

FIG. 1 depicts an exemplary well system 100 that may incorporate the principles of the present disclosure, according to one or more embodiments. The well system 100 includes a wellbore 102 drilled through one or more subterranean formations 104 and providing a first or "upper" portion 106*a* and a second or "lower" portion 106*b*, where the lower portion 106*b* extends the depth of the wellbore 102 deeper into the formations 104. The upper portion 106*a* has been drilled from a surface location (i.e., the Earth's surface) and subsequently lined with casing 108 that is secured in place within the wellbore 102 with cement 110. While only one string of casing 108 is depicted in FIG. 1, it will be appreciated that multiple strings of casing 108 may be concentrically arranged within the wellbore 102 and extend to varying depths. The lower portion 106*b* constitutes an extension of the wellbore 102 drilled after completing the upper portion 106*a*.

As illustrated, a downhole assembly 112 is extended within the wellbore 102 and conveyed downhole on a work string 114, such as jointed tubing (e.g., production tubing, drill pipe, etc.) or coiled tubing. The downhole assembly 112 may include a tool-orienting device 116, a restrictor sub 118, and a circulating valve 120. Each of the tool-orienting device 116, the restrictor sub 118, and the circulating valve 120 may be operatively coupled to each other and the work string 114 such that a fluid pumped downhole through the work string 114 from a surface location may be able to sequentially flow through each component. As used herein, the term "operatively coupled" refers to a direct or indirect coupling engagement between two component parts. Accordingly, while FIG. 1 depicts the tool-orienting device 116 directly coupled to the restrictor sub 118, and the restrictor sub 118 directly coupled to the circulating valve 120, it will be appreciated that a length of the work string 114, a downhole tool, or another intermediary sub may alternatively interpose each component, without departing from the scope of the disclosure.

The downhole assembly 112 may further include a liner running tool 122 used to convey a liner 124 into the lower portion 106*b* of the wellbore 102 and operate to secure the liner 124 in place. As illustrated, the liner 124 has been extended into and installed in the lower portion 106*b* of the wellbore 102 by suspending the liner 124 from the bottom of the casing 108 by means of a liner hanger 126 included in the liner running tool 122. The liner 124 is shown prior to being cemented in place by flowing cement into the annulus 128 defined between the liner 124 and the wellbore 102. Once the liner 124 and associated liner hanger 126 are set within the wellbore 102, a liner packer 130 included in the liner running tool 122 can then be operated to seal the upper end of the liner 124. The work string 114 may be configured to convey fluids (i.e., drilling fluid, cement, etc.) downhole and through the downhole assembly 112 and the liner 124 to operate the components of the downhole assembly 112 and thereby be used to orient and secure one or more downhole tools, such as the liner 124, in the wellbore 102.

The tool-orienting device 116 includes an operating unit 132 and a pulse-generating device 134 communicably coupled to the operating unit 132. The operating unit 132 includes a plurality of downhole sensors (not shown) that obtain real-time measurements of various downhole parameters, and the pulse-generating device 134 may be configured to transmit the acquired downhole parameter data in real-time via mud pulse telemetry to a surface location to help orient one or more downhole tools 136 (one shown). In some embodiments, the downhole tool 136 may be associated with the liner 124 and include, but is not limited to, a pre-milled window, a lateral bore junction for a multilateral wellbore, a wellbore packer (e.g., the liner packer 130), a sand screen deployment, a gravel pack deployment, a mule shoe, and any other known downhole tool requiring orientation. In other embodiments, however, the downhole tool 136 may comprise the liner running tool 122 and, more particularly, the liner hanger 126. For purposes of the following description, the downhole tool 136 will refer to any of the aforementioned tools, including the liner hanger 126.

The downhole sensors included in the operating unit 132 can include, but are not limited to, a weight sensor, a torque sensor, a gamma ray sensor, a directional sensor, a temperature sensor, a pressure sensor, a pulsed neutron tool, and the like. Accordingly, example downhole parameter data that can be obtained by the downhole sensors include, but are not limited to, weight and/or torque on the work string 114 or any portion of the downhole assembly 112, azimuth position of the downhole tool 136, the tool face direction of the downhole tool 136, and the temperature and/or pressure in the wellbore 102. As will be understood by persons skilled in the art, data relating to such downhole parameters may be vital to ensure proper landing, orienting, and securing of the downhole tool 136 in the wellbore 102.

Once the downhole parameter data is obtained, the operating unit 132 may be configured to operate the pulse-generating device 134 to send the acquired downhole parameter data to the well surface in real-time to help correctly orient the downhole tool 136 in the wellbore 102. The operating unit 132 includes suitable electronics that store the downhole parameter data, relay the downhole parameter data to the pulse-generating device 134, and provide power for overall operation of the tool-orienting device 116.

The restrictor sub 118 may be fluidly coupled to the tool-orienting device 116 such that fluid passing through the tool-orienting device 116 in the downhole direction can subsequently pass through the restrictor sub 118. As described below, the restrictor sub 118 may include a nozzle that generates a pressure drop that may be required to properly operate the pulse-generating device 134. Once a predetermined pressure differential is generated across the nozzle, however, the restrictor sub 118 may be configured to actuate and thereby increase the total flow area (i.e., the amount of capable fluid flow) through the restrictor sub 118.

The circulating valve 120 may be fluidly coupled to the restrictor sub 118 such that fluid passing through the restrictor sub 118 in the downhole direction can circulate through the circulating valve 120. When circulating, the fluid passing through the circulating valve 120 is ejected into a surrounding annulus 138 defined between the work string 114 and the casing 108. Moreover, the circulating valve 120 may allow fluid within the wellbore 102 to flow into the work string 114 in the uphole direction as the downhole assembly 112 is run downhole within the wellbore 102. More particularly, while running the downhole assembly 112 into the wellbore 102, fluid within the wellbore 102 and, more particularly, within the annulus 138, may circulate into the circulating valve 120 and equalize the pressure within the work string 114. Alternatively, and in the event the annulus 138 is filled with a gas and the work string 114 is filled with a liquid fluid at surface, the fluid within the work string 114 may be diverted into the annulus 138 via the circulating valve 120 as the downhole assembly 112 is run into the wellbore 102. Similar to the restrictor sub 118, the circulating valve 120 may also have a nozzle that restricts fluid flow through the circulating valve 120. Once a predetermined pressure differential is generated across its nozzle, the circulating valve 120 will actuate to close the valve and thereby prevent fluid circulation into the annulus 138.

With the circulating valve 120 in the closed position, the work string 114 may be pressurized to actuate one or more pressure-activated tools, such as one or both of the liner hanger 126 and the liner packer 130. In other embodiments, or in addition thereto, the downhole assembly 112 may include a separate pressure-activated tool 140, such as one that is included in the liner 124. In such embodiments, the pressure-activated tool 140 may comprise, but is not limited to, a wellbore isolation device, a screen assembly, or any downhole tool that can be actuated or activated by pressure. For purposes of the following description, the pressure-activated tool 140 will refer to any of the aforementioned tools, but may alternatively refer to one or both of the liner hanger 126 and the liner packer 130 when appropriate.

Figure 2A:
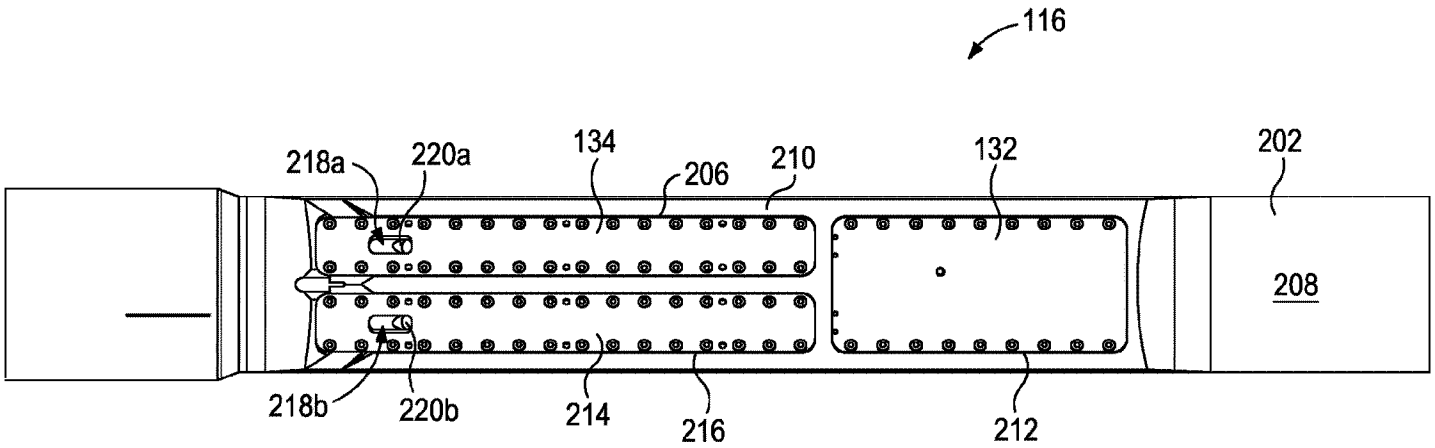
FIGS. 2A and 2B are side and isometric views, respectively, of an exemplary embodiment of the tool-orienting device of FIG. 1.
Figure 2B:
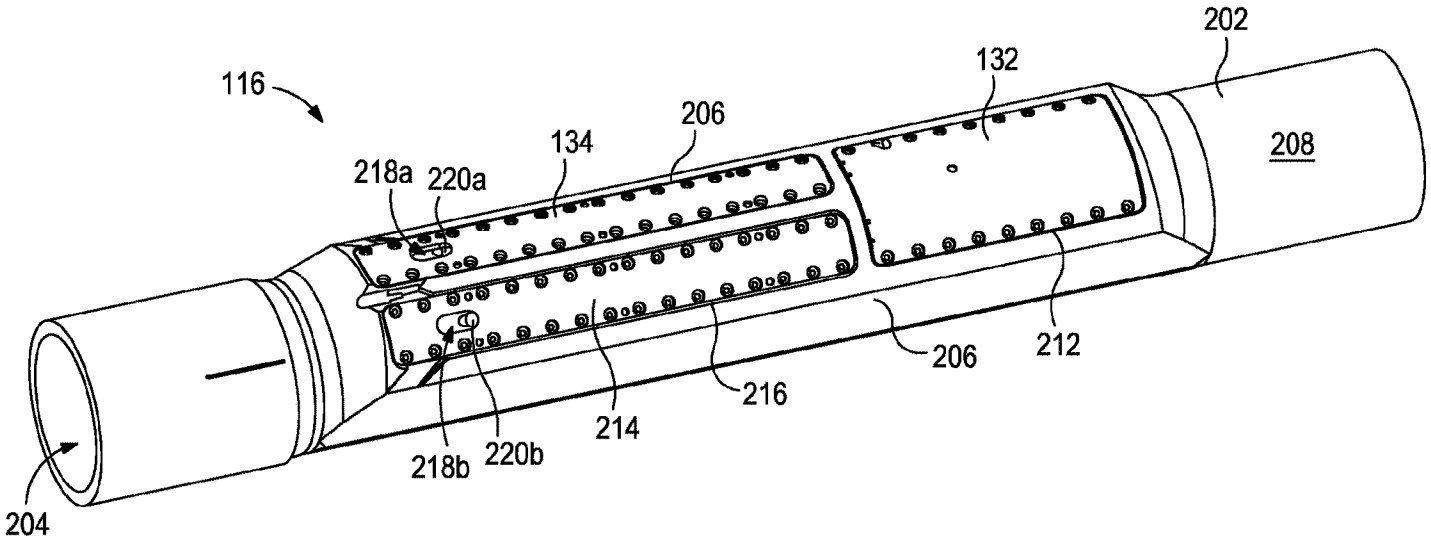

FIGS. 2A and 2B are side and isometric views, respectively, of an exemplary embodiment of the tool-orienting device 116. The tool-orienting device 116 may include an elongate, generally tubular housing 202 that defines an internal fluid flow passage 204 (FIG. 2B). The pulse-generating device 134 may be configured to be mounted to the housing 202 within a cavity 206 defined in an outer surface 208 of the housing 202. In the illustrated embodiment, the cavity 206 is depicted as being defined in a radial upset 210 formed on the outer surface 208 and otherwise extending radially outward therefrom. In other embodiments, however, the cavity 206 may be formed entirely in the wall of the housing 202 extending between the interior and outer surface 208 of the housing 202. In either case, the pulse-generating device 134 may be arranged such that it does not obstruct the internal fluid flow passage 204 such that the internal fluid flow passage 204 is able to exhibit an unrestricted diameter extending along the length of the housing 202 for the passage of tools or tubing through the tool-orienting device 116.

The operating unit 132 is also shown mounted to the housing 202 within a cavity 212 defined in the outer surface 208. As with the cavity 206, the cavity 212 may be defined in the radial upset 210, as illustrated, or alternatively formed entirely in the wall of the housing 202. In either case, the operating unit 132 is also positioned on the housing 202 such that it does not extend into and otherwise obstruct the internal fluid flow passage 204.

In some embodiments, as illustrated, the tool-orienting device 116 may include a second pulse-generating device 214, which may also be communicably coupled to the operating unit 132 and operated under the direction thereof. Similar to the first pulse-generating device 134, the second pulse-generating device 214 may be mounted to the housing 202 within a cavity 216 defined in the outer surface 208, where the cavity 216 is either defined in the radial upset 210 or otherwise formed entirely in the wall of the housing 202. In either case, the second pulse-generating device 214 may also be arranged such that it does not extend into and otherwise obstruct the internal fluid flow passage 204.

Each of the first and second pulse-generating devices 134, 214 may be configured to control the flow of fluid along a corresponding internal flow path 218, shown as internal flow paths 218*a* and 218*b*, respectively. Only part of the internal flow paths 218*a,b* are shown in FIGS. 2A and 2B. Each internal flow path 218*a,b* communicates with the internal fluid flow passage 204 and a corresponding outlet 220*a* and 220*b*, respectively, which fluidly communicates with the annulus 138 (FIG. 1) defined between the work string 114 (FIG. 1) and the casing 108 (FIG. 1). Controlling the fluid flow through the internal flow paths 218*a,b* will generate fluid pressure pulses that may be communicated to the well surface to transmit downhole parameter data. More particularly, the generation of negative pulses may be controlled by directing fluid into the annulus 138 via one or both of the outlets 220*a* and 220*b*.

The first and second pulse-generating devices 134, 214 can operate in a number of operating scenarios or configurations. In one operating scenario, for instance, the first and second pulse-generating devices 134, 214 may operate simultaneously such that the fluid pressure pulse generated by the tool-orienting device 116 is a combination of the fluid pressure pulses generated by the first and second pulse-generating devices 134, 214. In such a scenario, the frequency and amplitude of the fluid pressure pulses generated by the first and second pulse-generating devices 134, 214 may be similar such that the pulses complement and/or reinforce one another. In this way, the fluid pressure pulses generated by the tool-orienting device 116 have a magnitude (or amplitude) that is the sum of the magnitudes of the individual pulses generated by the first and second pulse-generating devices 134, 214.

In another operating scenario, the first and second pulse-generating devices 134, 214 may operate independently. This may prove advantageous in the event of failure of one of the first or second pulse-generating devices 134, 214. Accordingly, this provides a degree of redundancy without requiring the entire tool-orienting device 116 to be pulled out of the wellbore 102 (FIG. 1) and returned to the well surface for repair.

In yet another operating scenario, the first and second pulse-generating devices 134, 214 may be configured to transmit fluid pressure pulses representative of different downhole parameter data or the same parameter data measured at different times. When operated in this way, the pulse-generating devices 134, 214 will be activated individual and at separate times so that the generated fluid pressure pulses do not overlap, and thereby ensuring that the two pressure pulse signals can be distinguished at the surface location.

In an even further operating scenario, the first and second pulse-generating devices 134, 214 may be configured to transmit fluid pressure pulses to the surface location representative of the same downhole parameter data, but transmitted using different pulse profiles or signatures (pressure v. time). As will be appreciated, this may provide an ability to take account of particular operating scenarios in the well affecting pulse transmission. For example, the density and/or viscosity of fluids in the wellbore 102 and the presence of solids materials (e.g., drill cuttings) may impact the effectiveness or transmitting fluid pressure pulses to surface. A pulse of a different duration and/or amplitude, however, may be more easily transmitted (and so detected at surface) depending on the density and/or viscosity of the wellbore fluid or the presence of solids materials. Thus, the data required to be transmitted by the tool-orienting device 116 can be effectively transmitted in more than one way depending on downhole conditions.

In some embodiments, the first and second pulse-generating devices 134, 214 may be mounted in a side-by-side or parallel orientation. Other mounting configurations may be employed whereby the pulse-generating devices 134, 214 are positioned at various angular locations around the circumference of the housing 202. For example, the pulse-generating devices 134, 214 may be angularly offset from each other by 90°, 180°, or by other angular spacings with respect to one another.

Figure 3A:
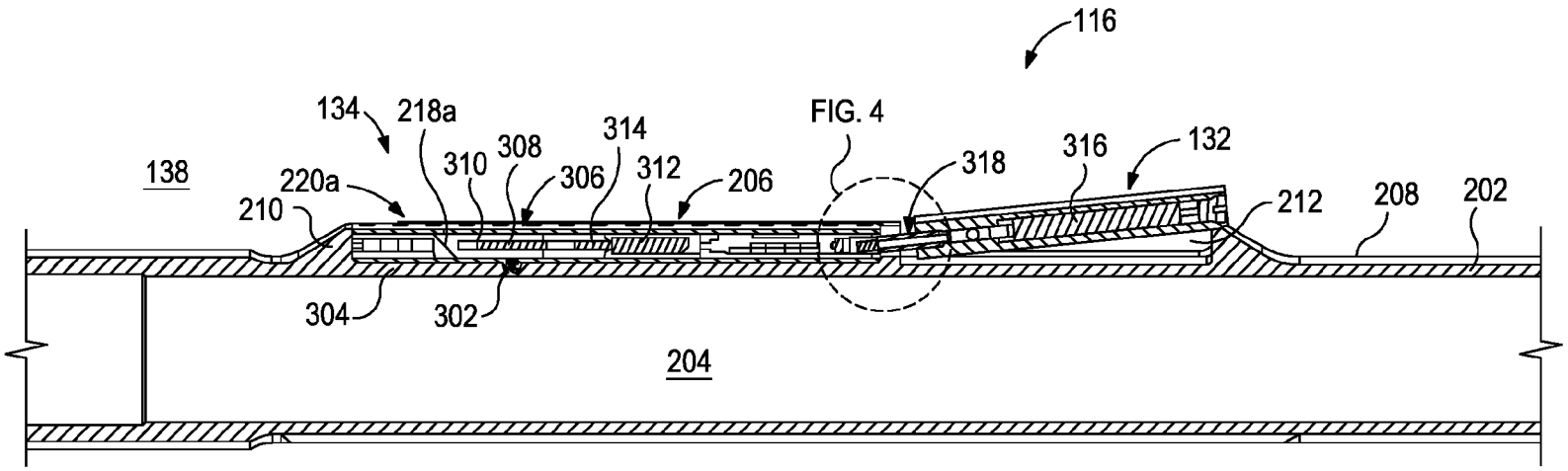
FIG. 3A is a cross-sectional side view of the fluid pulse generator of FIG. 1.
Figure 3B:
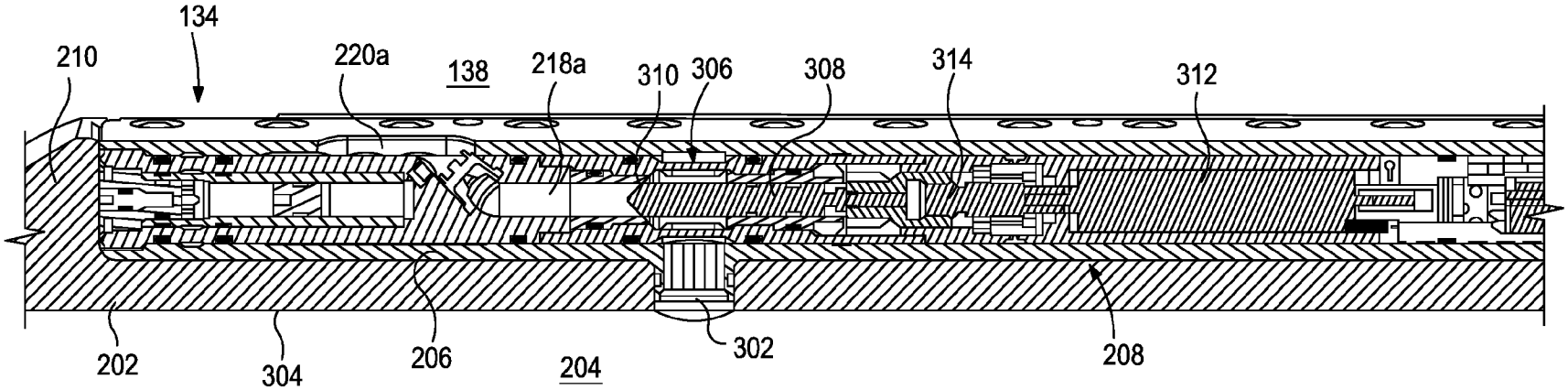
FIG. 3B is an enlarged view of the pulse-generating device of FIG. 3A.

FIG. 3A is a cross-sectional side view of the tool-orienting device 116 and the operating unit 132 of FIGS. 2A-2B, and FIG. 3B is an enlarged view of the pulse-generating device 134, according to one or more embodiments. Only the first pulse-generating device 134 is depicted in the illustrated cross-sections of FIGS. 3A and 3B. It will be appreciated, however, that the following description of the first pulse-generating device 134 is equally applicable to the second pulse-generating device 214 (FIGS. 2A-2B), if used.

The pulse-generating device 134 and the operating unit 132 may each be in the form of individual cartridges or inserts that can be releasably mounted in the housing 202 in their corresponding cavities 206, 212, respectively. The cartridges of the pulse-generating device 134 and the operating unit 132 are shaped and otherwise configured so that they are entirely mounted within their respective cavities 206, 212 and, therefore, do not take up significant space downhole and do not impede (obstruct) the internal flow passage 204. In this way, access to the wellbore 102 (FIG. 1) downhole of the tool-orienting device 116 can be achieved, such as for the passage of tools or tubing that may be required in well completion procedures.

The pulse-generating device 134 may include an inlet 302 defined in an inner wall 304 of the housing 202, and the outlet 220*a* is depicted radially opposite the inlet 302. The outlet 220*a* may be inclined relative to a main axis of the housing 202 so that, in use, fluid exiting the pulse-generating device 134 is jetted in an uphole direction into the annulus 138 along the wellbore 102 (FIG. 1) to surface. Accordingly, the inlet 302 to the internal flow path 218*a* and the outlet 220*a* may be provided at a generally common axial position along the length of the housing 202.

The pulse-generating device 134 includes a valve 306 positioned in the internal flow path 218*a* and including a valve element 308 and a valve seat 310. The valve 306 may be actuatable to control the flow of fluid within the internal flow path 218*a*. This is achieved by moving the valve element 308 into and out of sealing abutment (engagement) with the valve seat 310. The pulse-generating device 134 also includes an actuator 312 coupled to the valve element 308 to control the flow of fluid through the internal flow path 218*a*. The actuator 312 is electrically operated and takes the form of a solenoid or motor having a shaft linkage 314. The actuator shaft linkage 314 is coupled to the valve element 308 to control its axial movement and provide linear or rotary input for operation of the valve element 308, the latter being via a suitable rotary to linear converter. The structure of the valve 306 and the actuator 312 is substantially similar to that disclosed in co-owned U.S. Patent Pub. No. 2012/0106297 and, therefore, will not be described in further detail.

As illustrated, the internal flow path 218*a* extends from the inlet 302, through the valve 306, and to the outlet 220*a*. Accordingly, operation of the valve 306 controls the flow of fluid along the internal flow path 218*a* from the inlet 302 to the outlet 220*a* to generate fluid pressure pulses. Positive or negative fluid pressure pulses may be generated by the pulse-generating device 134 depending on how the valve 306 is operated. Positive pulses are generated by operating the valve 306 to close the internal flow path 218*a*, and negative pulses are generated by operating the valve 306 to open the internal flow path 218*a*. The generation of fluid pressure pulses may be achieved without restricting the internal flow passage 204.

The operating unit 132 is arranged to operate the pulse-generating device 134 (and the second pulse-generating device 214, if used), as required. The operating unit 132 includes an electronics section 316 communicably coupled to the pulse-generating device 134 via an electrical connector element 318.

Figure 4:
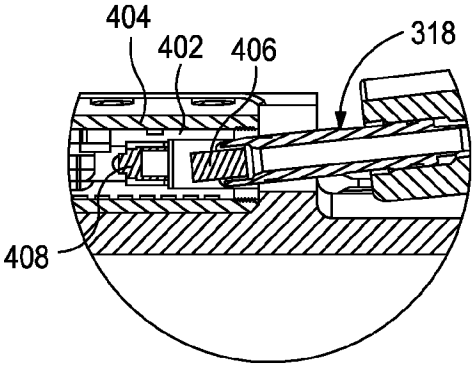
FIG. 4 is an enlarged portion of the fluid pulse generator of FIG. 3A and, more particularly, an enlarged portion of the operating unit, including a plunger for electrical connectivity.

FIG. 4 shows an enlarged portion of the operating unit 132 as indicated in FIG. 3A. As illustrated, the electrical connector element 318 may be located within a seal bore assembly 402 mounted within a bore 404 of the pulse-generating device 134. The end 406 of the electrical connector element 318 makes electrical connection with a corresponding socket 408, which transmits power to the actuator 312 (FIGS. 3A-3B). Operation of the actuator 312 causes the actuator shaft linkage 314 (FIGS. 3A-3B) to axially translate the valve element 308 (FIGS. 3A-3B) in and out of sealing engagement with the valve seat 310 (FIGS. 3A-3B). In some embodiments, one or more coil springs (not shown) may urge the valve element 308 into or out of engagement with the valve seat 310 when not in operation.

Figure 5:
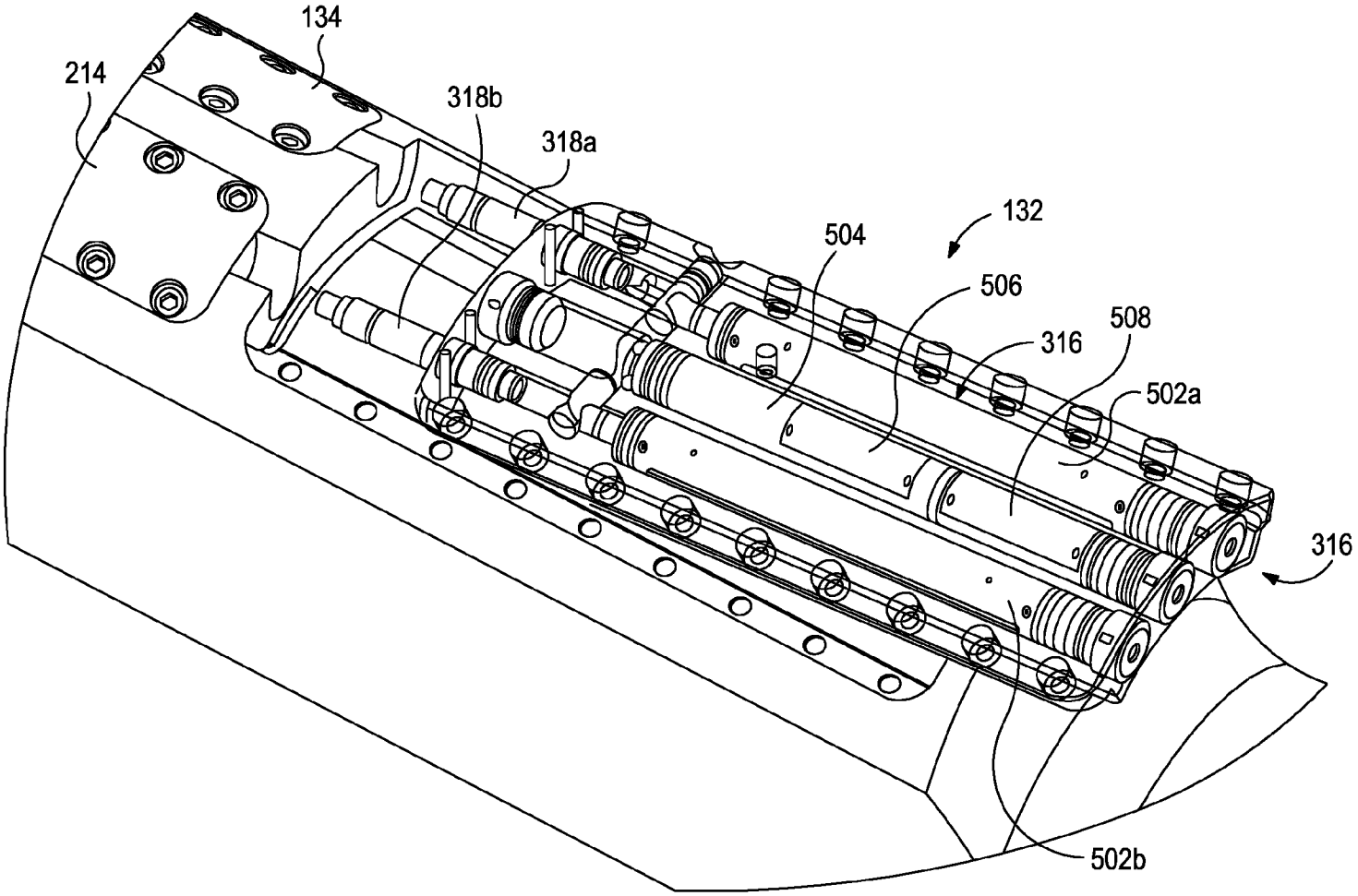
FIG. 5 is an enlarged isometric view of the operating unit of FIG. 3A and, more particularly, a power source and sensor assembly used in the operating unit.

FIG. 5 is an enlarged isometric view of the operating unit 132, according to one or more embodiments. As illustrated, the operating unit 132 may include an electrical power source in the form of a first battery 502*a* and a second battery 502*b*. The first and second batteries 502*a,b* may be electrically coupled to the first and second pulse-generating devices 134, 214 via a first electrical connector element 318*a* and a second electrical connector element 318*b*, respectively. In other embodiments, however, the second pulse-generating device 214 may be omitted and the first and second batteries 502*a,b* may each supply electrical power to the first pulse-generating device 134.

The electronics section 316 may include a sensor module assembly 504 that may include one or more downhole sensors 506 (one shown) and a data acquisition unit 508. As described above, the downhole sensor(s) 506 may be used to obtain real-time measurements of various downhole parameters during operation of the downhole assembly 112 (FIG. 1) and may include, but are not limited to, a weight sensor, a torque sensor, a gamma ray sensor, a directional sensor, a temperature sensor, a pressure sensor, a pulsed neutron tool, and the like. The downhole parameter data obtained by the downhole sensor(s) 506 may be conveyed to the data acquisition unit 508 for processing and transmission to the pulse-generating device 134 (and the second pulse-generating device 214, if used). The pulse-generating device 134 may then transmit the acquired downhole parameter data to surface via the mud pulse telemetry operation described above.

The data acquisition unit 508 may include computer hardware used to implement the methods described herein and may include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Figure 6A:
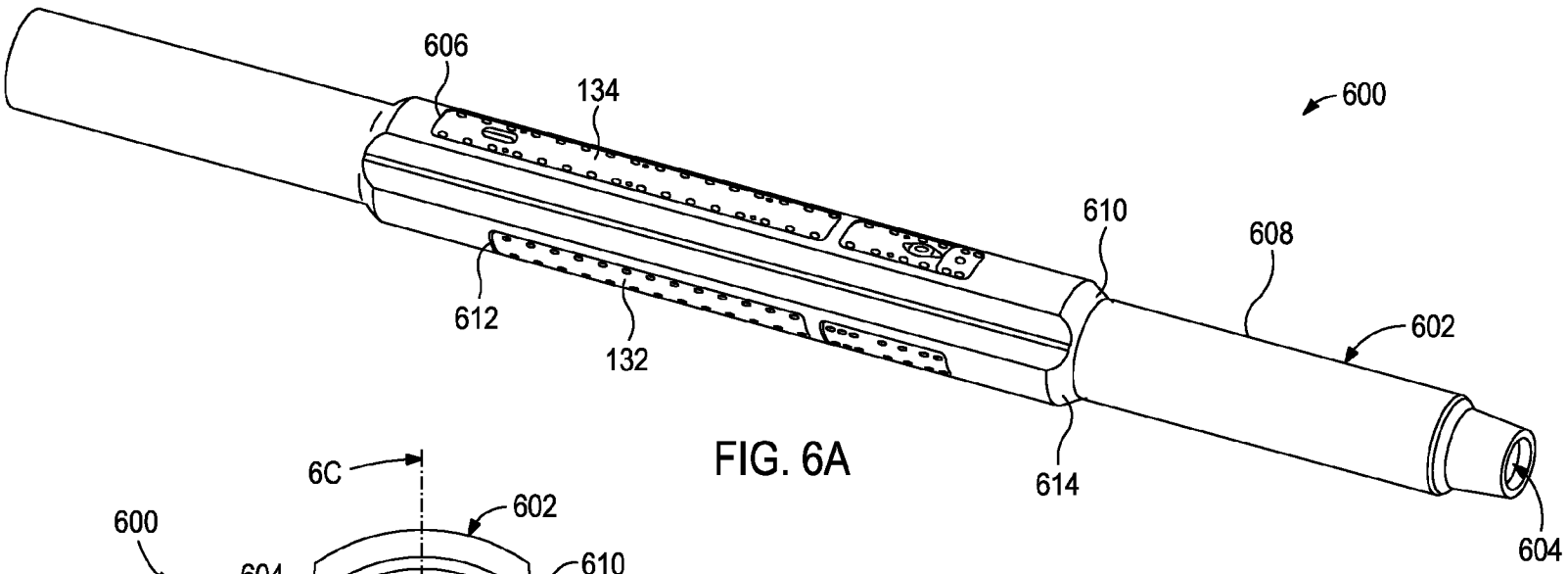
FIG. 6A is an isometric view of another exemplary embodiment of the tool-orienting device of FIG. 1.

FIG. 6A is an isometric view of another exemplary tool-orienting device 600, according to one or more embodiments. The tool-orienting device 600 may alternatively be used in place of the tool-orienting device 116 of FIGS. 1, 2A-2B, and 3A-3B. Moreover, the tool-orienting device 600 may be similar in some respects to the tool-orienting device 116 and therefore may be best understood with reference thereto, where like numerals represent like elements or components not described again. The tool-orienting device 600 includes an elongate, generally tubular housing 602 that defines an internal fluid flow passage 604 (best seen in FIGS. 5C and 5D). The pulse-generating device 134 may be mounted to the housing 602 within a cavity 606 defined in an outer surface 608 of the housing 602. In the illustrated embodiment, the cavity 606 is depicted as being defined in a radial upset 610 formed on the outer surface 608 and otherwise extending radially outward therefrom. In other embodiments, however, the cavity 606 may be formed entirely in the wall of the housing 602 extending between the interior and outer surface 608 of the housing 602. In either case, the pulse-generating device 134 may be arranged such that it does not obstruct the internal fluid flow passage 604 such that the internal fluid flow passage 604 is able to exhibit an unrestricted diameter extending along the length of the housing 602 for the passage of tools or tubing through the tool-orienting device 600.

The operating unit 132 is also shown mounted to the housing 602 within a corresponding cavity 612 defined in the outer surface 608. As with the cavity 606, the cavity 612 may be defined in the radial upset 610 or, as illustrated, in a second radial upset 614 angularly offset from the radial upset 610. Alternatively the cavity 612 may be formed entirely in the wall of the housing 602. In either case, the operating unit 132 is also positioned on the housing 602 such that it does not extend into and otherwise obstruct the internal fluid flow passage 604.

Figure 6B:
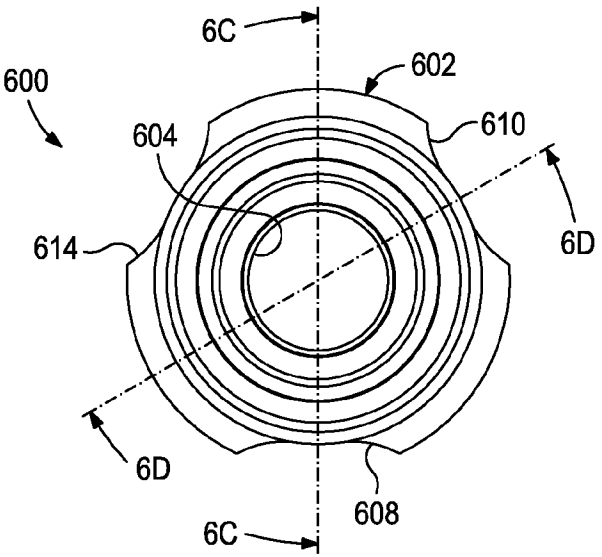
FIG. 6B is an end view of the tool-orienting device of FIG. 6A.
Figure 6C:
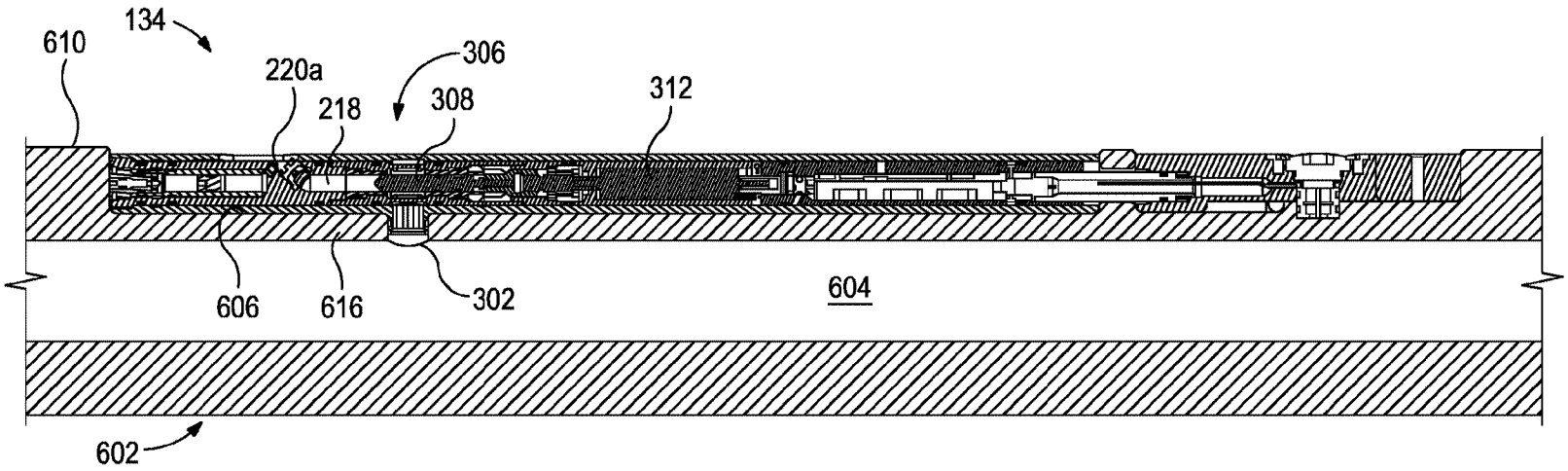
FIG. 6C is a cross-sectional side view of the tool-orienting device of FIG. 6A taken along the lines 5C-5C in FIG. 6B.
Figure 6D:
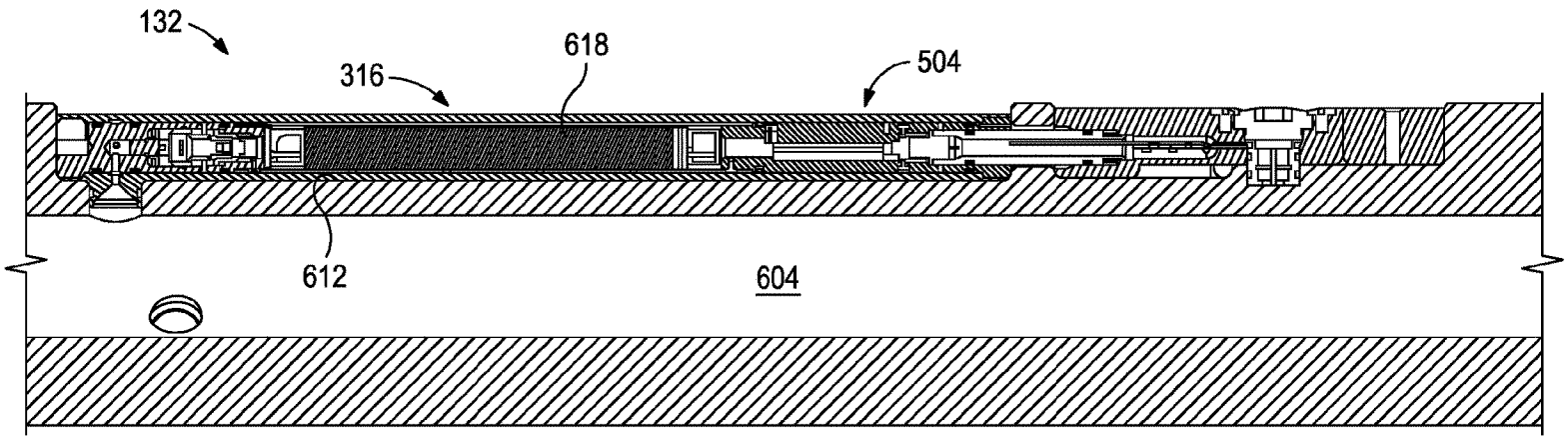
FIG. 6D is a cross-sectional side view of the tool-orienting device of FIG. 6A taken along the lines 6D-6D in FIG. 6B.

FIG. 6B is an end view of the tool-orienting device 600 and indicates cross-sectional side views for FIGS. 6C and 6D.

FIG. 6C is a cross-sectional side view of the tool-orienting device 600 taken along the lines 6C-6C in FIG. 6B, and FIG. 6D is a cross-sectional side view of the tool-orienting device 600 taken along the lines 6D-6D in FIG. 6B. More particularly, FIG. 6C provides an enlarged view of the pulse-generating device 134, and FIG. 6D provides an enlarged view of the operating unit 132. The pulse-generating device 134 and the operating unit 132 may each be in the form of individual cartridges or inserts that can be releasably mounted in the housing 602 in their corresponding cavities 606, 612, respectively. The pulse-generating device 134 and the operating unit 132 do not impede (obstruct) the internal flow passage 604.

The pulse-generating device 134 shown in FIG. 6C includes the inlet 302 defined in an inner wall 616 of the housing 602, and the outlet 220*a* is depicted radially opposite the inlet 302. The valve 306 is shown positioned in the internal flow path 218 and including the valve element 308, as described above. The actuator 312 is coupled to the valve element 308 to control the flow of fluid through the internal flow path 218.

The operating unit 132 shown in FIG. 6D includes the electronics section 316, which includes an electrical power source 618 (e.g., a battery) and the sensor module assembly 504 including one or more downhole sensors (i.e., the downhole sensors 506 of FIG. 5) and a data acquisition unit (i.e., the data acquisition unit 508 of FIG. 5). Downhole parameter data obtained by the downhole sensor(s) 506 may be conveyed to the data acquisition unit 508 for processing and transmission to the pulse-generating device 134. The pulse-generating device 134 may then transmit the acquired downhole parameter data to surface via the mud pulse telemetry operation described above.

Figure 7A:
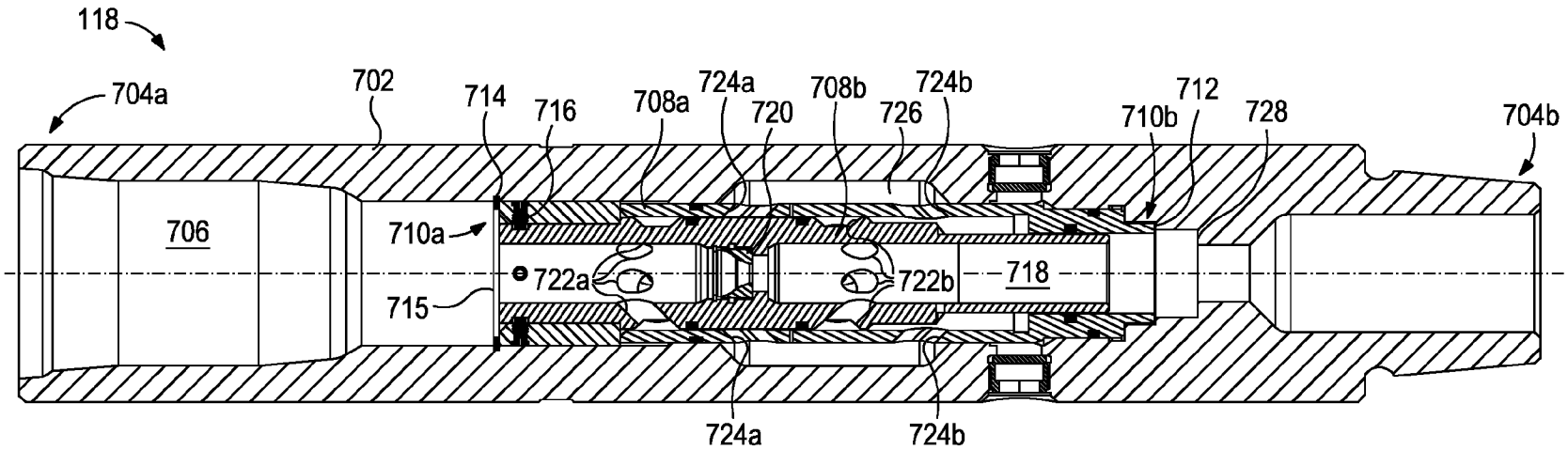
FIGS. 7A and 7B are cross-sectional side views of the restrictor sub of FIG. 1.
Figure 7B:
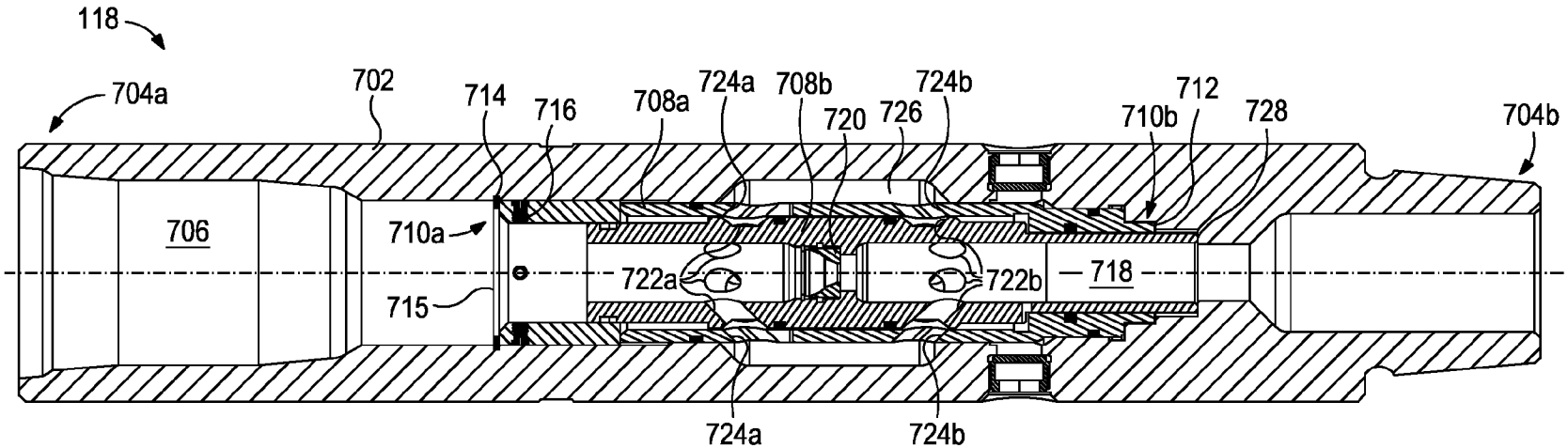

FIGS. 7A and 7B are cross-sectional side views of the restrictor sub 118 of FIG. 1, according to one or more embodiments. More particularly, FIG. 7A shows the restrictor sub 118 in a first or "un-actuated" position, and FIG. 7B shows the restrictor sub 118 in a second or "actuated" position. As illustrated, the restrictor sub 118 includes an elongate body 702 that provides an upper end 704*a*, a lower end 704*b*, and a central flow passage 706 extending between the upper and lower ends 704*a,b*. The upper end 704*a* may be configured to be operatively coupled to the lower end of the tool-orienting device 116 (FIG. 1), and the lower end 704*b* may be configured to be operatively coupled to the upper end of the circulating valve 120 (FIG. 1).

The restrictor sub 118 may further include an outer sleeve 708*a* and an inner sleeve 708*b*, each positioned within the central flow passage 706. The inner sleeve 708*b* is concentrically arranged within the outer sleeve 708*a* and is movable with respect thereto, as described below. The outer sleeve 708*a* may provide a top end 710*a* and a bottom end 710*b*. The outer sleeve 708*a* may be secured within the central flow passage 706 by advancing the outer sleeve 708*a* into the central flow passage 706 until the bottom end 710*b* engages a radial shoulder 712 defined by the inner wall of the body 702 within the central flow passage 706. A snap ring 714 or the like may subsequently be inserted into a groove 715 defined within the central flow passage 706 and engage the top end 710*a* to secure the outer sleeve 708*a* against the radial shoulder 712 and otherwise against axial movement within the central flow passage 706.

The inner sleeve 708*b* may be releasably secured to the outer sleeve 708*a* with one or more shearable devices 716 (two shown). In some embodiments, as illustrated, the shearable device(s) 716 may comprise one or more shear pins or shear screws that extend partially into the inner sleeve 708*b*. In other embodiments, the shearable device(s) 716 may comprise a shear ring or the like. In either case, the shearable device(s) 716 may be configured to shear and otherwise fail upon assuming a predetermined axial load, and thereby free the inner sleeve 708*b* to move axially within the central flow passage 706. With the shearable device(s) 716 intact, the inner sleeve 708*b* is secured in a first position, as shown in FIG. 7A, and shearing the shearable device(s) 716 allows the inner sleeve 708*b* to move axially within the central flow passage 706 with respect to the outer sleeve 708*a* to a second position, as shown in FIG. 7B.

The inner sleeve 708*b* may define an inner flow path 718 that fluidly communicates with the central flow passage 706 and allows fluids to circulate through the restrictor sub 118 between the upper and lower ends 704*a,b*. A nozzle 720 may be provided within the inner flow path 718 and provides a point of fluid restriction within the restrictor sub 118. The nozzle 720 may prove advantageous in helping to provide a required pressure drop that may be used by the pulse-generating device 134 (and the second pulse-generating device 214, if used) of the tool-orienting device 116 (FIGS. 1 and 2A-2B) to obtain proper pulse amplitudes on the generated pressure pulse signals. More particularly, when the valve 306 (FIGS. 3A-3B) is activated, a pressure drop can be detected at the surface that is consistent with the size of the nozzle 720 in the restrictor sub 118.

The inner sleeve 708*b* may further define one or more upper ports 722*a* and one or more lower ports 722*b*. As illustrated, the upper ports 722*a* are defined radially through the inner sleeve 708*b* uphole (i.e., to the left in FIGS. 7A-7B) from the nozzle 720, and the lower ports 722*b* are defined radially through the inner sleeve 708*b* downhole (i.e., to the right in FIGS. 7A-7B) from the nozzle 720. Similarly, the outer sleeve 708*a* may define one or more upper ports 724*a* and one or more lower ports 724*b*, where the lower ports 724*b* are defined downhole from the upper ports 724*a*. When the inner sleeve 708*b* is in the first position, the upper and lower ports 722*a,b* and 724*a,b* of the inner and outer sleeves 708*a,b*, respectively, are misaligned, as shown in FIG. 7A. When the inner sleeve 708*b* is in the second position, however, the upper and lower ports 722*a,b* and 724*a,b* become aligned, as shown in FIG. 7B. With the upper and lower ports 722*a,b* and 724*a,b* aligned, fluid in the inner flow path 718 may be able to flow into and out of a counter bore 726 defined in the body 702. Accordingly, when the inner sleeve 708*b* moves to the second position, the total flow area through the restrictor sub 118 increases as fluid is able to not only flow through the nozzle 720 but also around the nozzle 720 by flowing through the aligned upper ports 722*a*, 724*a* above the nozzle 720, through the counter bore 726, and back into the central flow passage 706 through the aligned lower ports 722*b*, 724*b* below the nozzle 720.

Exemplary operation of the restrictor sub 118 as part of the downhole assembly 112 of FIG. 1 is now provided. As the downhole assembly 112 is run into the wellbore 102 (FIG. 1), fluid may be pumped through the work string 114 (FIG. 1) and to the tool-orienting device 116 (FIGS. 1 and 2A-2B) at a first pressure P1 sufficient to operate the pulse-generating device 134 (and the second pulse-generating device 214, if used), as described above. The fluid at the first pressure P1 may also circulate through the restrictor sub 118 in the un-actuated position, where the inner sleeve 708*b* is in the first position, as shown in FIG. 7A. The fluid passes through the central flow passage 706 and into the inner flow path 718 wherein it impinges upon the nozzle 720. As the fluid at the first pressure P1 impinges upon the nozzle 720, a pressure drop is created across the nozzle 720, which results in an axial load being applied on the inner sleeve 708*b*. The axial load resulting from the fluid at the first pressure P1, however, may be insufficient to shear the shearable device 716 and, therefore, the inner sleeve 708*b* remains in the first position while the fluid circulates through the restrictor sub 118 at the first pressure P1.

The fluid may circulate at the first pressure P1 while the tool-orienting device 116 provides orientation measurements that help a well operator rotate the work string 114 and thereby properly orient the downhole tool 136 (FIG. 1) within the wellbore 102, as described above. Once operation of the tool-orienting device 116 is no longer needed, however, the pulse-generating device 134 (and the second pulse-generating device 214, if used) may optionally be switched to a non-pulsing mode and the fluid pressure within the work string 114 may be increased to a second pressure P2 by increasing the flow rate. The fluid may circulate through the restrictor sub 118 at the second pressure P2 and thereby generate a larger pressure drop across the nozzle 720, which results in an increased axial load applied on the inner sleeve 708*b* sufficient to shear the shearable device 716 and detach the inner sleeve 708*b* from the outer sleeve 708*a*. The inner sleeve 708*b* may then be free to axially move to the second position within the outer sleeve 708*a* under hydraulic force of the fluid applied to the nozzle 720.

The inner sleeve 708*b* may move axially within the outer sleeve 708*a* until engaging a lower radial shoulder 728 defined by the inner wall of the body 702 within the central flow passage 706. With the inner sleeve 708*b* in the second position, the upper and lower ports 722*a,b* and 724*a,b* become aligned and the total flow area through the restrictor sub 118 is thereby increased to allow the fluid to not only pass through the nozzle 720 but also flow around the nozzle 720 via the aligned upper and lower ports 722*a,b* and 724*a,b* and the counter bore 726. The fluid is discharged from the aligned lower ports 722*b* and 724*b* and reintroduced back into the central flow passage 706 via the inner flow path 718.

Figure 8A:
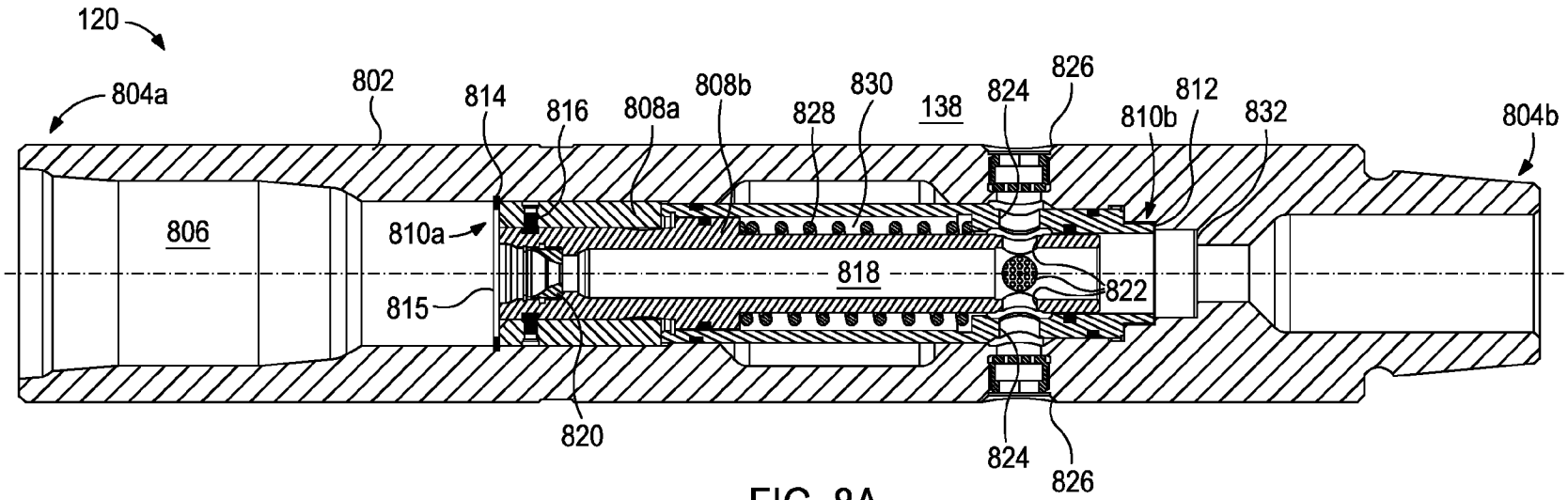
FIGS. 8A and 8B are cross-sectional side views of the circulating valve of FIG. 1.
Figure 8B:
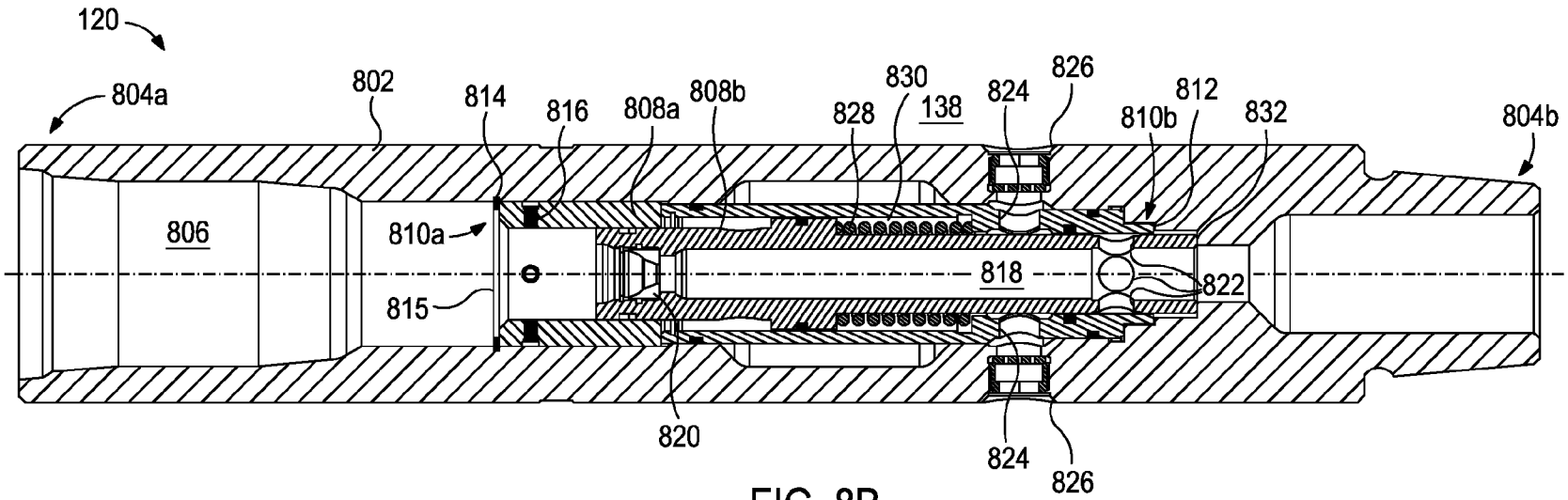

FIGS. 8A and 8B are cross-sectional side views of the circulating valve 120 of FIG. 1, according to one or more embodiments. More particularly, FIG. 8A shows the circulating valve 120 in a first or "open" position, and FIG. 8B shows the circulating valve 120 in a second or "closed" position. As illustrated, the circulating valve 120 includes an elongate body 802 that provides an upper end 804*a*, a lower end 804*b*, and a central flow passage 806 extending between the upper and lower ends 704*a,b*. The upper end 804*a* may be configured to be operatively coupled to the lower end 704*b* of the restrictor sub 118 (FIGS. 7A-7B), and the lower end 804*b* may be configured to be operatively coupled to the upper end of the liner running tool 122 (FIG. 1).

The circulating valve 120 may further include an outer sleeve 808*a* and an inner sleeve 808*b*, each positioned within the central flow passage 806. The inner sleeve 808*b* is concentrically arranged within the outer sleeve 808*a* and is movable with respect thereto, as described below. The outer sleeve 808*a* may provide a top end 810*a* and a bottom end 810*b*. The outer sleeve 808*a* may be secured within the central flow passage 806 by advancing the outer sleeve 808*a* into the central flow passage 806 until the bottom end 810*b* engages a radial shoulder 812 defined by the inner wall of the body 802 within the central flow passage 806. A snap ring 814 or the like may be inserted into a groove 815 defined within the central flow passage 806 and engage the top end 810*a* to secure the outer sleeve 808*a* against the radial shoulder 812 and otherwise against axial movement within the central flow passage 806.

The inner sleeve 808*b* may be releasably secured to the outer sleeve 808*a* using one or more shearable devices 816 (two shown). The shearable device(s) 816 may be similar to the shearable devices 716 (FIGS. 7A-7B) described above and will not be described again. With the shearable device(s) 816 intact, the inner sleeve 808*b* is secured in a first position, as shown in FIG. 8A, and shearing the shearable device(s) 816 allows the inner sleeve 708*b* to move axially within the central flow passage 806 with respect to the outer sleeve 808*a* to a second position, as shown in FIG. 8B.

The inner sleeve 808*b* may define an inner flow path 818 that fluidly communicates with the central flow passage 806 and allows fluids to circulate through the circulating valve 120 between the upper and lower ends 704*a,b*. A nozzle 820 may be provided within the inner flow path 818 and provide a point of fluid restriction within the circulating valve 120.

The inner sleeve 808*b* may further define one or more circulating ports 822 (three shown) defined radially through the inner sleeve 808*b*, and the outer sleeve 808*a* may define one or more transition ports 824 (two shown) defined radially through the outer sleeve 808*a*. When the inner sleeve 808*b* is in the first position, as shown in FIG. 8A, the circulating and transition ports 822, 824 are aligned and thereby facilitate fluid communication between the inner flow path 818 and one or more radial flow ports 826 (two shown) defined in the body 802. The radial flow ports 826 may be configured to discharge a fluid to the exterior of the circulating valve 120 and, more particularly, into the annulus 138 defined between the work string 114 (FIG. 1) and the casing 108 (FIG. 1). When the inner sleeve 808*b* is moved to the second position, however, as shown in FIG. 8B, the circulating and transition ports 822, 824 become misaligned and thereby prevent fluid communication between the inner flow path 818 and the annulus 138 via the radial flow ports 826.

The circulating valve 120 may further include a spring 828 positioned within a spring chamber 830 cooperatively defined between the outer and inner sleeves 808*a,b*. The spring 828 may comprise a coil compression spring configured to naturally urge the inner sleeve 808*b* to the first position. When the inner sleeve 808*b* is move to the second position, as shown in FIG. 8B, the spring 828 compresses and builds spring energy.

Exemplary operation of the circulating valve 120 as part of the downhole assembly 112 of FIG. 1 is now provided. As the downhole assembly 112 is advanced downhole within the wellbore 102 (FIG. 1), fluids within the wellbore 102 may be able to flow into the circulating valve 120 in the uphole direction (i.e., to the left in FIGS. 8A-8B). With the circulating valve 120 in the open position, the wellbore fluids may be diverted out of the circulating valve 120 and into the annulus 138 by passing through the aligned circulating and transition ports 822, 824 and the radial flow ports 826.

At some point while advancing the downhole assembly 112 downhole within the wellbore 102, a fluid may be pumped through the work string 114 at the first pressure P1, as discussed above. The flow rate of the fluid at the first pressure P1 may circulate through the tool-orienting device 116 (FIGS. 1 and 2A-2B) to operate the pulse-generating device 134 (and the second pulse-generating device 214, if used). As indicated above, however, the fluid at the first pressure P1 is insufficient to actuate the restrictor sub 118 (FIGS. 1 and 7A-7B). The fluid at the first pressure P1 may also be insufficient to actuate the circulating valve 120 from the open position to the closed position.

Once operation of the tool-orienting device 116 (FIGS. 1 and 2A-2B) is no longer needed, the flow rate of the fluid may be increased to increase the pressure to the second pressure P2 to actuate the restrictor sub 118 to the actuated position, as discussed above. The fluid at the second pressure P2 also circulates through the circulating valve 120 in the open position, where the inner sleeve 808*b* is in the first position, as shown in FIG. 8A. The fluid passes through the central flow passage 806, including the inner flow path 818 and the nozzle 820, and a pressure drop is created across the nozzle 820. The flow rate of the fluid at the second pressure P2 creates an axial load on the inner sleeve 808*b* as the fluid impinges on the inner sleeve 808*b* at the nozzle 820. In some embodiments, the axial load resulting from the second pressure P2 may be sufficient to shear the shearable device 816 and, therefore, the circulating valve 120 may move the closed position simultaneously with actuation of the restrictor sub 118, or shortly thereafter.

In other embodiments, however, the axial load resulting from the second pressure P2 may be insufficient to shear the shearable device 816 and, therefore, the inner sleeve 808*b* remains in the first position while the fluid circulates through the circulating valve 120 at the second pressure P2. In such embodiments, to shear the shearable device 816, the flow rate of the fluid may be increased to increase the pressure to a third pressure P3, where P1<P2<P3. The third pressure P3 may circulate through the circulating valve 120 and thereby generate a larger pressure drop across the nozzle 820, which creates an increased axial load on the inner sleeve 808*b* sufficient to shear the shearable device 816 and detach the inner sleeve 808*b* from the outer sleeve 808*a*. The inner sleeve 808*b* may then be free to axially move to the second position within the outer sleeve 808*a* until engaging a lower radial shoulder 832 defined by the inner wall of the body 802 within the central flow passage 806. With the inner sleeve 808*b* in the second position, the circulating and transition ports 822, 824 become misaligned, thereby preventing fluid communication between the inner flow path 818 and the annulus 138 via the radial flow ports 826. Moving the inner sleeve 808*b* to the second position also compresses the spring 828 within the spring chamber 830.

With the circulating valve 120 in the closed position, the flow rate of the fluid may again be increased to increase the pressure within the work string 114 above the third pressure P3 to a fourth pressure P4 that is required to activate the pressure-activated tool 140 (FIG. 1), where P1<P2<P3<P4. As will be appreciated, having the restrictor sub 118 and the circulating valve 120 actuate at the second and third pressures P2 and P3, respectively, may prove advantageous in providing a double safety measure that prevents premature setting of the pressure-activated tool 140 before the pressure-activated tool 140 is properly positioned in the wellbore 102 (FIG. 1).

In some embodiments, the work string 114 may be blanked off at its distal end and, therefore, the fourth pressure P4 may be achieved quite rapidly as fluid flow out of the work string 114 is prevented. In such embodiments, the pressure-activated tool 140 may be the one or both of the liner hanger 126 (FIG. 1) and the liner packer 130 (FIG. 1) and activation of the liner hanger 126 and/or the liner packer 130 may occur in a controlled sequence as pump rates for the fluid are slowed and stopped. In other embodiments, however, there may be a small restriction or nozzle at the end of the work string 114 and, therefore, the fourth pressure P4 may be achieved in a more gradual fashion to set the pressure-activated tool 140.

Following activation of the pressure-activated tool 140 at the fourth pressure P4, the flow rate of the fluid may be reduced to thereby reduce the pressure and allow the liner running tool 122 to be released from the liner 124 (FIG. 1). In embodiments where the work string 114 is blanked off at its distal end, the fluid pressure may be reduced to zero at surface (e.g., operation of the pumps is stopped or flow to the work string 114 is bypassed). In embodiments where there is a small amount of fluid flow out the distal end of the work string 114, the pressure may be reduced by reducing the flow rate of the fluid through the work string 114. Reducing the pressure of the fluid below the fourth pressure P4 will allow the spring force of the spring 828 to move the inner sleeve 808*b* back to the first position, where the circulating and transition ports 822, 824 are aligned once again with the radial flow ports 826. Once the liner running tool 122 is released from the liner 124, and the work string 114 and the downhole assembly 112 (FIG. 1) may be returned to the surface location. As the downhole assembly 112 is returned to the surface location, and since the circulating valve 120 is returned to its open position, fluid may be able to drain out of the work string 114 via the radial flow ports 826.

Various modifications or alterations may be made to the restrictor sub 118 and the circulating valve 120 to alter the pressures required to actuate the restrictor sub 118 and the circulating valve 120. For instance, the size of the nozzles 720, 820 of the restrictor sub 118 and the circulating valve 120 may be varied to modify what pressure differential across the nozzles 720, 820 is required to shear the shearable devices 716, 816. Accordingly, in such embodiments, the magnitude of the second and third pressures P2, P3 may be optimized to fit a particular application. Similarly, the size or shear rating of the shearable devices 716, 816 may be optimized to tailor what pressure differential across the nozzles 720, 820 is required to shear the shearable devices 716, 816. As will be appreciated, the size of the nozzles 720, 820 of the restrictor sub 118 and the circulating valve 120 and the size or shear rating of the shearable devices 716, 816 may be subject to the mud weight (i.e., the weight of the fluid circulating through the assembly 110. Accordingly, the pressure constraints on the restrictor sub 118 and the circulating valve 120 may be optimized to fit any desired downhole application.

It should be noted that, in at least one embodiment, the tool-orienting device 116 may be replaced with a measure-while-drilling (MWD) tool and an associated mud-pulse telemetry module, without departing from the scope of the disclosure. The MWD tool may be configured to provide essentially the same wellbore monitoring capabilities as the operating unit 132, and the telemetry module may provide essentially the same communication capabilities as the pulse-generating devices, 134, 214. Advantages of using the tool-orienting device 116, as described herein, however, include the lower cost of the tool as compared to conventional MWD tools and telemetry modules, the ability of the tool-orienting device 116 to operate at lower fluid flow rates as compared to conventional telemetry modules, and the ease of configuration of the restrictor sub 118 in generating optimized negative pressure pulses.

The embodiments described herein may prove advantageous where it is required to leave a pressure-activated tool downhole for a period of time, such as in the case of a subsea well application where the well has to be temporarily abandoned on account of bad weather. For instance, it is common to run a liner running tool into a wellbore with a blank end and a pressure-activated device below it with wellbore fluid flowing into the work string as the assembly is run downhole. In the event bad weather forms at the surface, it may be required to hang off the liner within the wellbore and move the floating platform or rig out of the vicinity so that it is not damaged by the weather. While the well is temporarily shut in, the fluid temperature within the wellbore can increase, which can increase the fluid pressure and prematurely activate the pressure-activated tool at the wrong depth within the wellbore. The presently described assemblies and methods, however, prevents the pressure-activated tool from prematurely activating since there is not a closed volume of fluid. In such an application, the above-described circulating valve 120 could be deployed in the well without the above-described restrictor sub 118 and the orientating tool 116.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Embodiments disclosed herein include:

A. A downhole assembly that includes a tool-orienting device including an operating unit having one or more downhole sensors and a pulse-generating device used to orient a downhole tool within the wellbore, a restrictor sub operatively and fluidly coupled to the tool-orienting device and including a nozzle that restricts fluid flow through the restrictor sub, a circulating valve operatively and fluidly coupled to the restrictor sub and including a nozzle that restricts fluid flow through the circulating valve, and a liner running tool operatively coupled to the circulating valve to convey a liner and a pressure-activated tool into the wellbore, wherein the pulse-generating device operates with a fluid at a first pressure and the restrictor sub is actuatable to increase a total flow area through the restrictor sub by increasing the first pressure to a second pressure, and wherein the circulating valve is actuated by the fluid at a third pressure and the pressure-activated tool is activated by increasing the third pressure to a fourth pressure.

B. A method that includes advancing a downhole assembly into a wellbore on a work string, the downhole assembly including a tool-orienting device, a restrictor sub operatively and fluidly coupled to the tool-orienting device, a circulating valve operatively and fluidly coupled to the restrictor sub, and a liner running tool operatively coupled to the circulating valve to convey a liner and a pressure-activated tool into the wellbore, pumping a fluid through the work string and the downhole assembly at a first pressure, obtaining downhole parameter measurements with one or more sensors of the tool-orienting device and transmitting the downhole parameter measurements to a surface location with a pulse-generating device of the tool-orienting device, orienting a downhole tool within the wellbore based on the downhole parameter measurements, increasing the first pressure to a second pressure to actuate the restrictor sub and thereby increase a total flow area through the restrictor sub, wherein the restrictor sub includes a nozzle that restricts fluid flow from the tool-orienting device through the restrictor sub, pumping the fluid at a third pressure through the circulating valve to actuate the circulating valve, wherein the circulating valve includes a nozzle that restricts fluid flow from the restrictor sub through the circulating valve, and increasing the third pressure to a fourth pressure to activate the pressure-activated tool.

Each of embodiments A and B may have one or more of the following additional elements in any combination: Element 1: wherein the first pressure is less than the second pressure, the second pressure is less than the third pressure, and the third pressure is less than the fourth pressure. Element 2: wherein the first pressure is less than the second pressure, the second pressure is the same as the third pressure, and the second and third pressures are less than the fourth pressure. Element 3: wherein the downhole tool comprises a tool selected from the group consisting of a liner hanger of the liner running tool, a pre-milled window, a lateral bore junction, a wellbore packer, a sand screen deployment, a mule shoe, and a gravel pack deployment. Element 4: wherein the one or more downhole sensors are selected from the group consisting of a weight sensor, a torque sensor, a gamma ray sensor, a directional sensor, a temperature sensor, a pressure sensor, and a pulsed neutron tool. Element 5: wherein the pressure-activated tool comprises a tool selected from the group consisting of a liner packer, a liner hanger, and a wellbore packer. Element 6: wherein the tool-orienting device includes a housing that defines an internal fluid flow passage and the pulse-generating device is mounted within a cavity defined in an outer surface of the housing such that the internal fluid flow passage remains unobstructed. Element 7: wherein the pulse-generating device comprises an inlet defined in an inner wall of the housing within the internal fluid flow passage, an outlet defined on an outer surface of the housing, an internal flow path extending between the inlet and the outlet, and a valve positioned in the internal flow path and including a valve element axially movable within the internal flow path to engage and disengage a valve seat and thereby generate fluid pressure pulses. Element 8: wherein the restrictor sub comprises a body that defines a central flow passage and a counter bore, an outer sleeve secured within the central flow passage and defining one or more upper ports and one or more lower ports, and an inner sleeve concentrically arranged within the outer sleeve and providing an inner flow path that receives the nozzle of the restrictor sub and fluidly communicates with the central flow passage, wherein the inner sleeve defines one or more upper ports above the nozzle and one or more lower ports below the nozzle and the inner sleeve is releasably secured to the outer sleeve with one or more shearable devices, wherein the second pressure actuates the restrictor sub from an unactuated position, where the upper and lower ports of the inner and outer sleeves, respectively, are misaligned, to an actuated position, where the shearable devices fail and the inner sleeve moves axially within the outer sleeve to align the upper and lower ports of the inner and outer sleeves, respectively, and thereby allow fluid flow both through the nozzle and around the nozzle by flowing through the aligned upper and lower ports and the counter bore. Element 9: wherein the circulating valve comprises a body that defines a central flow passage and one or more radial ports, an outer sleeve secured within the central flow passage and defining one or more transition ports, an inner sleeve concentrically arranged within the outer sleeve and providing an inner flow path that receives the nozzle of the circulating valve and fluidly communicates with the central flow passage, wherein the inner sleeve defines one or more circulating ports and is releasably secured to the outer sleeve with one or more shearable devices, and wherein the third pressure actuates the circulating sub from an open position, where the circulating and transition ports are aligned and facilitate fluid communication between the inner flow path and an exterior of the body via the one or more radial flow ports, and a closed position, where the shearable devices fail and the inner sleeve moves axially within the outer sleeve to misalign the circulating and transition ports and thereby prevent fluid communication between the inner flow path the exterior via the one or more radial flow ports. Element 10: wherein the circulating valve further comprises a spring positioned within a spring chamber cooperatively defined between the outer and inner sleeves, the spring being configured to naturally urge the inner sleeve to align the circulating and transition ports.

Element 11: wherein orienting the downhole tool within the wellbore comprises orienting at least one of a liner hanger of the liner running tool, a pre-milled window, a lateral bore junction, a wellbore packer, a sand screen deployment, a mule shoe, and a gravel pack deployment. Element 12: wherein the pressure-activated tool comprises a tool selected from the group consisting of a liner packer, a liner hanger, and a wellbore packer. Element 13: wherein the tool-orienting device includes a housing that defines an internal fluid flow passage and the pulse-generating device is mounted within a cavity defined in an outer surface of the housing such that the internal fluid flow passage remains unobstructed, and wherein transmitting the downhole parameter measurements to the surface location with the pulse-generating device comprises actuating a valve element movably positioned within an internal flow path extending between an inlet defined in an inner wall of the housing within the internal fluid flow passage and an outlet defined on an outer surface of the housing, and generating fluid pressure pulses as the valve element engages and disengages a valve seat. Element 14: wherein the restrictor sub comprises a body that defines a central flow passage and a counter bore, an outer sleeve secured within the central flow passage and defining one or more upper ports and one or more lower ports, and an inner sleeve concentrically arranged within the outer sleeve and defining one or more upper ports above and one or more lower ports, and wherein increasing the first pressure to the second pressure to actuate the restrictor sub comprises impinging the fluid at the second pressure on the nozzle of the restrictor sub, the nozzle being positioned within an inner flow path of the inner sleeve that fluidly communicates with the central flow passage, applying an axial load on the inner sleeve based on the fluid at the second pressure and thereby shearing one or more shearable devices that secure the inner sleeve to the outer sleeve, and moving the inner sleeve from a first position within the outer sleeve, where the upper and lower ports of the inner and outer sleeves, respectively, are misaligned, to a second position, where the upper and lower ports of the inner and outer sleeves, respectively, align and allow fluid flow through both the nozzle and around the nozzle by flowing through the aligned upper and lower ports and the counter bore. Element 15: wherein the circulating valve comprises a body defining a central flow passage and one or more radial ports, an outer sleeve secured within the central flow passage and defining one or more transition ports, and an inner sleeve concentrically arranged within the outer sleeve and defining one or more circulating ports, and wherein pumping the fluid at the third pressure through the circulating valve to actuate the circulating valve comprises impinging the fluid at the third pressure on the nozzle of the circulating valve, the nozzle being positioned within an inner flow path of the inner sleeve that fluidly communicates with the central flow passage, applying an axial load on the inner sleeve based on the fluid at the third pressure and thereby shearing one or more shearable devices that secure the inner sleeve to the outer sleeve, and moving the inner sleeve from a first position within the outer sleeve, where the circulating and transition ports are aligned and facilitate fluid communication between the inner flow path and an exterior of the body via the one or more radial flow ports, and a second position, where the circulating and transition ports are misaligned and thereby prevent fluid communication between the inner flow path the exterior via the one or more radial flow ports. Element 16: wherein advancing the downhole assembly into the wellbore comprises receiving wellbore fluids into the circulating valve in an uphole direction, and diverting the wellbore fluids into an annulus defined between the body and the wellbore by circulating the wellbore fluids through aligned circulating and transition ports and the radial flow ports. Element 17: wherein moving the inner sleeve from the first position within the outer sleeve to the second sleeve comprises compressing a spring within a spring chamber cooperatively defined between the outer and inner sleeves, the method further comprising decreasing the fourth pressure and thereby allowing the spring to expand and move the inner sleeve back to the first position, releasing the liner running tool from the liner, returning the work string and the downhole assembly to a surface location, and draining fluid out of the downhole assembly via the aligned circulating and transition ports and the one or more radial flow ports.

Element 18: wherein increasing the first pressure to the second pressure is preceded by switching the pulse-generating device to a non-pulsing mode. Element 19: further comprising modifying a size of the nozzle of one or both of the restrictor sub and the circulating valve and thereby altering a pressure differential required to actuate the restrictor sub or the circulating valve.

By way of non-limiting example, exemplary combinations applicable to A and B include: Element 6 with Element 7; Element 9 with Element 10; Element 15 with Element 16; and Element 15 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A downhole assembly, comprising:

a tool-orienting device to orient a downhole tool within the wellbore, the tool-orienting device including an operating unit having one or more downhole sensors and a pulse-generating device, wherein the pulse-generating device operates with a fluid pressure at a first pressure, the pulse-generating device configured to transmit acquired downhole parameter data in real-time via mud pulse telemetry to a surface location;

a restrictor sub operatively and fluidly coupled to the tool-orienting device and including a first nozzle that restricts fluid flow through the restrictor sub, wherein the restrictor sub is actuatable to increase a total flow area through the restrictor sub by increasing the fluid pressure to a second pressure;

a circulating valve operatively and fluidly coupled to the restrictor sub and including a second nozzle that restricts fluid flow through the circulating valve, wherein the circulating valve is actuated by the fluid pressure at a third pressure; and a liner running tool operatively coupled to the circulating valve to convey a liner and a pressure-activated tool into the wellbore, wherein the pressure-activated tool is actuated by the fluid pressure at a fourth pressure.

2. The downhole assembly of claim 1, wherein the first pressure is less than the second pressure, the second pressure is less than the third pressure, and the third pressure is less than the fourth pressure.

3. The downhole assembly of claim 1, wherein the first pressure is less than the second pressure, the second pressure is the same as the third pressure, and the second and third pressures are less than the fourth pressure.

4. The downhole assembly of claim 1, wherein the downhole tool comprises a tool selected from the group consisting of a liner hanger of the liner running tool, a pre-milled window, a lateral bore junction, a wellbore packer, a sand screen deployment, a mule shoe, and a gravel pack deployment.

5. The downhole assembly of claim 1, wherein the one or more downhole sensors are selected from the group consisting of a weight sensor, a torque sensor, a gamma ray sensor, a directional sensor, a temperature sensor, a pressure sensor, and a pulsed neutron tool.

6. The downhole assembly of claim 1, wherein the pressure-activated tool comprises a tool selected from the group consisting of a liner packer, a liner hanger, and a wellbore packer.

7. The downhole assembly of claim 1, wherein the tool-orienting device includes a housing that defines an internal fluid flow passage and the pulse-generating device is mounted within a cavity defined in an outer surface of the housing such that the internal fluid flow passage remains unobstructed.

8. The downhole assembly of claim 7, wherein the pulse-generating device comprises:

an inlet defined in an inner wall of the housing within the internal fluid flow passage;

an outlet defined on the outer surface of the housing;

an internal flow path extending between the inlet and the outlet; and a valve positioned in the internal flow path and including a valve element axially movable within the internal flow path to engage and disengage a valve seat and thereby generate fluid pressure pulses.

9. The downhole assembly of claim 1, wherein the restrictor sub comprises:

a body that defines a central flow passage and a counter bore;

an outer sleeve secured within the central flow passage and defining one or more upper ports and one or more lower ports; and an inner sleeve concentrically arranged within the outer sleeve and providing an inner flow path that receives the first nozzle and fluidly communicates with the central flow passage, wherein the inner sleeve defines one or more upper ports above the first nozzle and one or more lower ports below the first nozzle and the inner sleeve is releasably secured to the outer sleeve with one or more shearable devices configured to shear and fail upon receiving a predetermined axial load, wherein the second pressure actuates the restrictor sub from an un-actuated position, where the upper and lower ports of the inner and outer sleeves, respectively, are misaligned, to an actuated position, where the shearable devices fail and the inner sleeve moves axially within the outer sleeve to align the upper and lower ports of the inner and outer sleeves, respectively, and thereby allow fluid flow both through the first nozzle and around the first nozzle by flowing through the aligned upper and lower ports and the counter bore.

10. The downhole assembly of claim 1, wherein the circulating valve comprises:

a body that defines a central flow passage and one or more radial ports;

an outer sleeve secured within the central flow passage and defining one or more transition ports; and an inner sleeve concentrically arranged within the outer sleeve and providing an inner flow path that receives the second nozzle and fluidly communicates with the central flow passage, wherein the inner sleeve defines one or more circulating ports and is releasably secured to the outer sleeve with one or more shearable devices configured to shear and fail upon receiving a predetermined axial load, and wherein the third pressure actuates the circulating sub from an open position, where the circulating and transition ports are aligned and facilitate fluid communication between the inner flow path and an exterior of the body via the one or more radial flow ports, and a closed position, where the shearable devices fail and the inner sleeve moves axially within the outer sleeve to misalign the circulating and transition ports and thereby prevent fluid communication between the inner flow path the exterior via the one or more radial flow ports.

11. The downhole assembly of claim 10, wherein the circulating valve further comprises a spring positioned within a spring chamber cooperatively defined between the outer and inner sleeves, the spring being configured to naturally urge the inner sleeve to align the circulating and transition ports.

12. A method, comprising:

advancing a downhole assembly into a wellbore on a work string, the downhole assembly including a tool-orienting device, a restrictor sub operatively and fluidly coupled to the tool-orienting device, a circulating valve operatively and fluidly coupled to the restrictor sub, and a liner running tool operatively coupled to the circulating valve to convey a liner and a pressure-activated tool into the wellbore;

pumping a fluid through the work string and the downhole assembly at a first pressure;

obtaining downhole parameter measurements with one or more sensors of the tool-orienting device and transmitting the downhole parameter measurements to a surface location with a pulse-generating device of the tool orienting device, the pulse-generating device configured to transmit acquired downhole parameter data in real-time via mud pulse telemetry to a surface location;

orienting a downhole tool within the wellbore based on the downhole parameter measurements;

increasing a pressure of the fluid to a second pressure to actuate the restrictor sub and thereby increase a total flow area through the restrictor sub, wherein the restrictor sub includes a first nozzle that restricts fluid flow from the tool-orienting device through the restrictor sub; pumping the fluid at a third pressure through the circulating valve to actuate the circulating valve, wherein the circulating valve includes a second nozzle that restricts fluid flow from the restrictor sub through the circulating valve; and increasing the pressure of the fluid to a fourth pressure to activate the pressure-activated tool.

13. The method of claim 12, wherein orienting the downhole tool within the wellbore comprises orienting at least one of a liner hanger of the liner running tool, a pre-milled window, a lateral bore junction, a wellbore packer, a sand screen deployment, a mule shoe, and a gravel pack deployment.

14. The method of claim 12, wherein the pressure-activated tool comprises a tool selected from the group consisting of a liner packer, a liner hanger, and a wellbore packer.

15. The method of claim 12, wherein the tool-orienting device includes a housing that defines an internal fluid flow passage and the pulse-generating device is mounted within a cavity defined in an outer surface of the housing such that the internal fluid flow passage remains unobstructed, and wherein transmitting the downhole parameter measurements to the surface location with the pulse-generating device comprises:

actuating a valve element movably positioned within an internal flow path extending between an inlet defined in an inner wall of the housing within the internal fluid flow passage and an outlet defined on the outer surface of the housing; and generating fluid pressure pulses as the valve element engages and disengages a valve seat.

16. The method of claim 12, wherein the restrictor sub comprises a body that defines a central flow passage and a counter bore, an outer sleeve secured within the central flow passage and defining one or more upper ports and one or more lower ports, and an inner sleeve concentrically arranged within the outer sleeve and defining one or more upper ports above and one or more lower ports, and wherein increasing the first pressure to the second pressure to actuate the restrictor sub comprises:

impinging the fluid at the second pressure on the first nozzle of the restrictor sub, the first nozzle being positioned within an inner flow path of the inner sleeve that fluidly communicates with the central flow passage;

applying an axial load on the inner sleeve based on the fluid at the second pressure and thereby shearing one or more shearable devices that secure the inner sleeve to the outer sleeve, the one or more shearable devices configured to shear and fail upon receiving a predetermined axial load; and moving the inner sleeve from a first position within the outer sleeve, where the upper and lower ports of the inner and outer sleeves, respectively, are misaligned, to a second position, where the upper and lower ports of the inner and outer sleeves, respectively, align and allow fluid flow through both the first nozzle and around the first nozzle by flowing through the aligned upper and lower ports and the counter bore.

17. The method of claim 12, wherein the circulating valve comprises a body defining a central flow passage and one or more radial ports, an outer sleeve secured within the central flow passage and defining one or more transition ports, and an inner sleeve concentrically arranged within the outer sleeve and defining one or more circulating ports, and wherein pumping the fluid at the third pressure through the circulating valve to actuate the circulating valve comprises:

impinging the fluid at the third pressure on the second nozzle of the circulating valve, the second nozzle being positioned within an inner flow path of the inner sleeve that fluidly communicates with the central flow passage;

applying an axial load on the inner sleeve based on the fluid at the third pressure and thereby shearing one or more shearable devices that secure the inner sleeve to the outer sleeve, the one or more shearable devices configured to shear and fail upon receiving a predetermined axial load; and moving the inner sleeve from a first position within the outer sleeve, where the circulating and transition ports are aligned and facilitate fluid communication between the inner flow path and an exterior of the body via the one or more radial flow ports, and a second position, where the circulating and transition ports are misaligned and thereby prevent fluid communication between the inner flow path the exterior via the one or more radial flow ports.

18. The method of claim 17, wherein advancing the downhole assembly into the wellbore comprises:

receiving wellbore fluids into the circulating valve in an uphole direction; and diverting the wellbore fluids into an annulus defined between the body and the wellbore by circulating the wellbore fluids through aligned circulating and transition ports and the radial flow ports.

19. The method of claim 17, wherein moving the inner sleeve from the first position within the outer sleeve to the second sleeve comprises compressing a spring within a spring chamber cooperatively defined between the outer and inner sleeves, the method further comprising:

decreasing the fourth pressure and thereby allowing the spring to expand and move the inner sleeve back to the first position;

releasing the liner running tool from the liner;

returning the work string and the downhole assembly to a surface location; and draining fluid out of the downhole assembly via the aligned circulating and transition ports and the one or more radial flow ports.

20. The method of claim 12, wherein increasing the first pressure to the second pressure is preceded by switching the pulse-generating device to a non-pulsing mode.

* * * * *